US007376365B2

(12) United States Patent
Stahuber

(10) Patent No.: US 7,376,365 B2
(45) Date of Patent: May 20, 2008

(54) METHOD AND DEVICE FOR PREVENTING UNWANTED TRANSFER OF TONER WITH A CLEANING STATION AND A CLEANING DEVICE IN A TRANSFER PRINTING STATION OF AN ELECTROGRAPHIC PRINTING MACHINE

(75) Inventor: Markus Stahuber, Miesbach (DE)

(73) Assignee: Oce Printing Systems GmbH, Poing (DE)

( * ) Notice: Subject to any disclaimer, the term of this patent is extended or adjusted under 35 U.S.C. 154(b) by 352 days.

(21) Appl. No.: 10/523,200

(22) PCT Filed: Jul. 29, 2003

(86) PCT No.: PCT/EP03/08381

§ 371 (c)(1),
(2), (4) Date: Aug. 23, 2005

(87) PCT Pub. No.: WO2004/013701

PCT Pub. Date: Feb. 12, 2004

(65) Prior Publication Data

US 2006/0013601 A1 Jan. 19, 2006

(30) Foreign Application Priority Data

Jul. 30, 2002 (DE) ..... 102 34 711

(51) Int. Cl.
*G03G 21/12* (2006.01)

(52) U.S. Cl. ..... 399/35; 399/101

(58) Field of Classification Search ..... 399/35, 399/81, 101, 66, 303, 312, 313, 360
See application file for complete search history.

(56) References Cited

U.S. PATENT DOCUMENTS 4,903,081 A 2/1990 Takahashi (Continued)

FOREIGN PATENT DOCUMENTS

EP 0 339 673 4/1989

(Continued)

OTHER PUBLICATIONS

Patent Abstracts of Japan—2000181312—Jun. 30, 2000.

(Continued)

*Primary Examiner*—Robert Beatty
(74) *Attorney, Agent, or Firm*—Schiff Hardin LLP

(57) ABSTRACT

In a method and system for operation of a transfer printing station of an electrographic printing device, a transfer printing station is provided comprising a light-sensitive medium onto which toner images are provided by electrostatic forces affected via a toner image electrical potential. A transport band is provided holding successive sheet-form recording medium by electrostatic forces. Toner images are transfer printed from the light-sensitive medium onto the successive sheet-form recording media by electrostatic forces affected by an electrical transfer printing potential. The electrical transfer printing potential is at least reduced while the light-sensitive medium passes into intervening space line between two successive recording media sheets. A cleaning station cleans off residual toner on the light-sensitive medium that is not transfer-printed. A cleaning device mechanically loosens residual toner from the transport band. A toner quantity sensor is provided for at least one of a residual toner reservoir of the cleaning station and a residual toner reservoir of the cleaning device. The sensor provides an operator an indication to exchange at least one of the residual toner reservoirs.

21 Claims, 5 Drawing Sheets

U.S. PATENT DOCUMENTS

| | | | | |
|---|---|---|---|---|
| 5,815,784 | A * | 9/1998 | Kasahara et al. | 399/358 |
| 6,044,244 | A | 3/2000 | Watanabe et al. | |
| 6,311,031 | B1 * | 10/2001 | Hirano | 399/101 |
| 6,631,249 | B2 * | 10/2003 | Katsumi et al. | 399/71 |
| 6,704,528 | B1 * | 3/2004 | Kawamura et al. | 399/123 |
| 2002/0154924 | A1 | 10/2002 | Takahashi et al. | |

FOREIGN PATENT DOCUMENTS

| | | | |
|---|---|---|---|
| JP | 8-227259 | A | 3/1996 |
| JP | 11194675 | A * | 7/1999 |
| JP | 11265090 | | 9/1999 |
| JP | 2000122499 | A * | 4/2000 |
| JP | 2001324841 | | 11/2001 |
| JP | 2001324905 | A * | 11/2001 |
| JP | 2002156843 | | 5/2002 |
| JP | 2002169385 | | 6/2002 |
| JP | 2002196644 | A * | 7/2002 |
| WO | WO 99/36834 | | 7/1999 |

OTHER PUBLICATIONS

Digitale Druckverfahren für Variable Daten—May 2001, p. 9-21.

* cited by examiner

METHOD AND DEVICE FOR PREVENTING UNWANTED TRANSFER OF TONER WITH A CLEANING STATION AND A CLEANING DEVICE IN A TRANSFER PRINTING STATION OF AN ELECTROGRAPHIC PRINTING MACHINE

BACKGROUND

The disclosure concerns a method as well as a device for printing of information by means of an electrographic printing device. Such printing devices are known in a plurality of configurations, for example as electrophotographic printing devices, as ionographic printing devices or as magnetographic printing. Various physical effects are respectively used in order to initially generate a virtual image on an intermediate image carrier, to ink this virtual image with suitable dye (in particular toner), and to transfer-print the image so generated onto a recording medium.

Such digital printing methods for variable data are, for example, specified in the publication "Das Druckerbuch, Technik und Technologien der Océ-Drucksystem, Drucktechnologien, Océ Printing Systems GmbH", 6th edition (May 2001), ISBN 3-000-00 1019-X in chapter 9, third section (pages 9-21 through 9-36).

For printing of sheet-form recording medium, it is known from U.S. Pat. No. 6,044,244 A to respectively pass the recording medium on a transport band to the intermediate image carrier. The transport band thereby causes the sheet-form recording medium to remain on its desired transport web because it adheres to the transport band and does not remain electrostatically adhered to the intermediate image carrier. Thus a paper jam can be prevented.

It has emerged that, in transfer printing arrangements that comprise such a transport band for a sheet-form recording medium, toner particles are transferred from the intermediate image carrier onto the transport band. The cause for such an unwanted toner transfer onto the transport band can, for example, be a print image projection in which the transferred image is larger than the format of the recording medium. Toner markings in the edge region of the intermediate image carrier or in the intervening spaces that result in the spaces between successive recording media (what are known as gaps) can also lead to such unwanted toner transfers onto the transport band. A regulation method for developer stations that operate on the basis of toner markings is known from the publication WO 99/36834 A1.

Further causes for an unwanted transfer of toner onto a transport band are undefined charged toner particles (background) that are located on the inked image of the intermediate image carrier as well as toner image regions that are not transfer-printed dependent on the transfer printing efficiency $\Pi_{Transfer}$.

An electrographic printing device with a plurality of transfer printing stations and a transport band for transportation of the recording medium is known from JP 2002-169385 A. Electrographic printing devices with a reservoir for residual toner are known from JP 2000-181312 A and from JP 11265090 A.

A method for operation of a transfer printing station of an electrographic printing device is known from EP 0 339 673 A2, in which the transfer printing potential in the region of the transfer printing station is dissipated as long as no paper traverses the station.

Further methods and transfer printing stations are disclosed in JP 2001-324841, JP 2002-156,843 and U.S. Pat. No. 4,903,081

SUMMARY

It is an object of the invention to specify a method and a device for an electrographic printing device with which unwanted toner transfer is prevented in a transfer printing station in which the sheet-form recording media that are passed by a light-sensitive medium by means of a transport band for the purpose of transferring toner images.

In a method and system for operation of a transfer printing station of an electrographic printing device, a transfer printing station is provided comprising a light-sensitive medium onto which toner images are provided by electrostatic forces affected via a toner image electrical potential. A transport band is provided holding successive sheet-form recording medium by electrostatic forces. Toner images are transfer printed from the light-sensitive medium onto the successive sheet-form recording media by electrostatic forces affected by an electrical transfer printing potential. The electrical transfer printing potential is at least reduced while the light-sensitive medium passes into intervening space line between two successive recording media sheets. A cleaning station cleans off residual toner on the light-sensitive medium that is not transfer-printed. A cleaning device mechanically loosens residual toner from the transport band. A toner quantity sensor is provided for at least one of a residual toner reservoir of the cleaning station and a residual toner reservoir of the cleaning device. The sensor provides an operator an indication to exchange at least one of the residual toner reservoirs.

DESCRIPTION OF THE PREFERRED EMBODIMENT

Figure 1:
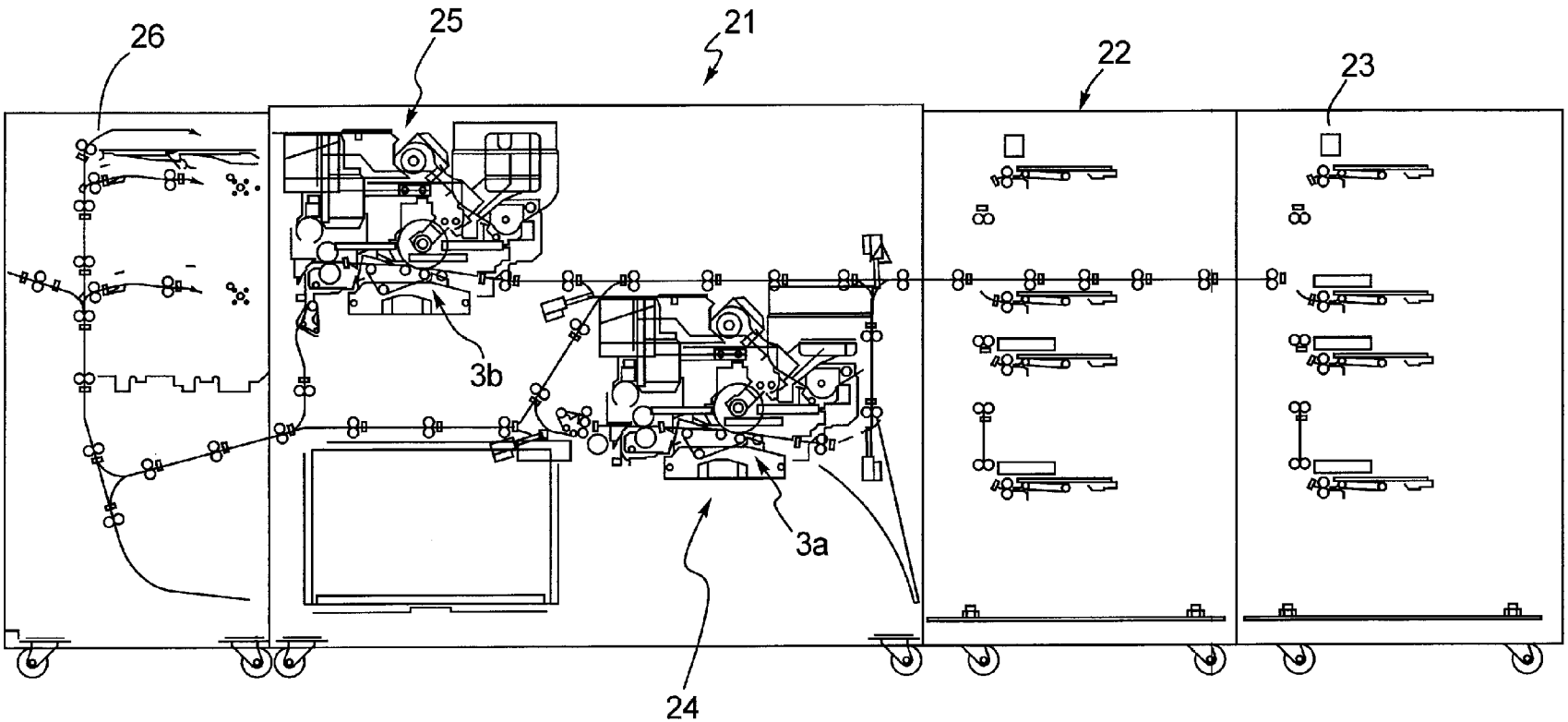
FIG. 1 illustrates an electrophotographic device.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

A transfer printing station comprises a light-sensitive medium onto which a toner image adheres by means of electrostatic forces that are effected by an electrical potential as well as a transport band on which the recording medium is held by means of electrostatic forces for the purposes of the transfer printing of the toner image from the light-sensitive medium onto a sheet-form recording medium. The transfer printing thereby occurs by means of electrostatic forces that are effected by an electrical transfer printing potential opposite the potential of the toner image. The electrical transfer printing potential is dissipated while the light-sensitive medium passes an intervening space lying between two recording media. Via the temporary dissipation of the transfer printing potential, it is possible in the intervening space to generate a toner marking on the light-sensitive medium, whereby this is transfer-printed onto the transport band to an only insignificant degree. Such toner markings are useful in order to regularly adjust electrographic parameters, however should optimally also not be transfer-printed onto the recording medium. With the disclosed embodiment, a solution is specified in order to, on the one hand, be able to use toner markings with high performance, i.e. without reducing the printing speed, and on the other hand to prevent an interfering transfer printing of the same toner markings.

With the preferred embodiment, it can furthermore be prevented that unwanted toner particles are transferred from the light-sensitive medium onto the transport band at times of the operation of the transfer printing station at which no recording medium lies against the light-sensitive medium. This effect can be used particularly effectively in the running operation of the printing device, when successive recording media run into the transfer printing station with a certain separation interval or intervening space. Via the deactivation of the transfer printing corotron during the times in which the light-sensitive medium passes the intervening space (gap), and thus the transport band contacts the light-sensitive medium along a wide surface, no or only a few toner particles are transferred from the light-sensitive medium onto the transport band. In particular it is prevented that, in addition to the mechanically-dependent transfer, toner arrives onto the toner band due to the electrical transfer printing potential.

In an advantageous embodiment, a control device is used that, from the image sequence of the electrographic recording process, derives at which times no recording medium lies against the light-sensitive medium and then effects the dissipation of the transfer printing potential. The transport band has in particular an electrical volume resistance greater than $10^{10}$ Ω cm, whereby the transfer printing potential also effects the electrostatic forces to hold the recording medium. Both the light-sensitive medium and the transport band can be provided with cleaning stations that effect a continuous cleaning of toner particles still located on the respective element. The cleaning stations can furthermore comprise mechanically persistent contacting ends via which the toner particles can be abraded. To clean the scratch-sensitive photosensitive medium, a softer material such as, for example, rubber or soft plastic is thereby preferably provided, while harder material such as, for example, metal, hard plastic or ceramic and in particular polyimide can be used for cleaning of the more robust transport band. The residual toner reservoirs at both cleaning stations are thereby in particular designed such that they become approximately full simultaneously given an average accumulation of residual toner quantities in both cleaning stations. In this case, it is sufficient to arrange at only one of the two reservoirs a fill level sensor with which it is shown to the operator of the device when the residual toner reservoirs are to be emptied or exchanged with empty reservoirs.

With the preferred embodiment, an arrangement is thus specified with which the accumulation of residual toner in an electrographic device can be specifically conducted into specific processing channels, whereby in particular a compact design can be realized in that arrangements for removal of residual toner are provided that transport the old toner to suitable locations in which sufficient structural space is available for residual toner reservoirs and/or the reservoirs are easily accessible from the outside. The preferred embodiment in particular enables less residual station of a photoconductor drum.

In electrophotographic printing device 21 is shown in FIG. 1 in which individual sheet-form recording media made from paper from a paper input can be printed in a first printing group 24 and/or in a second printing group 25 and can then be transported to a paper output 26 for depositing in output bays and/or for further processing in further paper processing devices. Each of the two printing groups 24, 25 thereby comprises a transfer printing station 3*a* or 3*b* in which toner images that are applied onto a photoconductor drum are transfer-printed onto the paper sheet. In order to simultaneously hold in reserve an optimally large spectrum of various papers, the printing device 21 comprises a second paper input 23 that largely corresponds to the paper input 22 with regard to its mechanical and electrical design and can deliver paper pages through the paper input 22 to one or both of the printing groups 24, 25 for printing.

Figure 2:
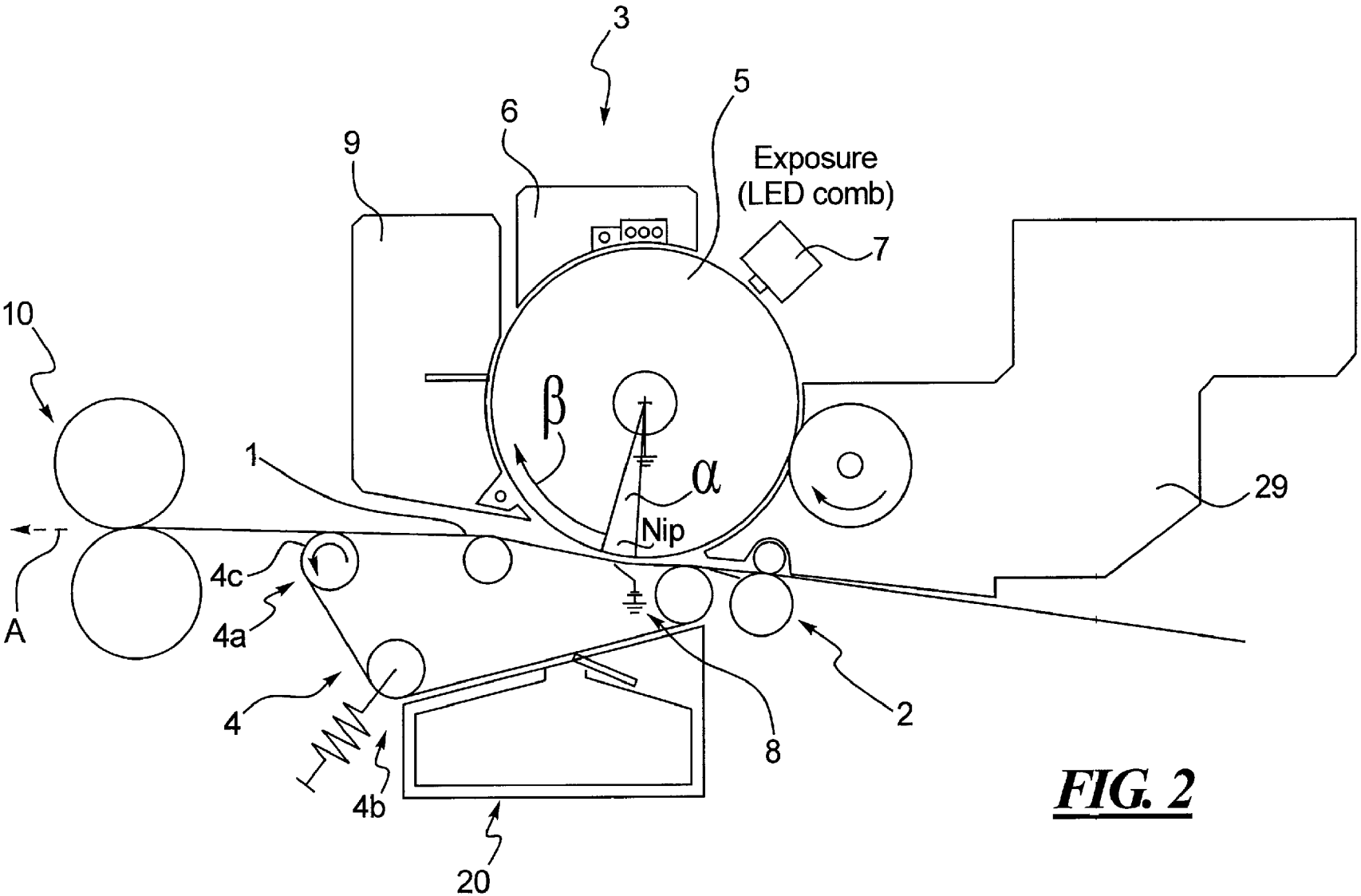
FIG. 2 shows a transfer printing developer and fixing station in the device of FIG. 1.

A transfer printing station 3 with somewhat more detail is shown in FIG. 2. A paper sheet 1 is thereby supplied to a paper transport band 4 via transport rollers 2. The paper transport band 4 is charged to a high electrical potential of 2 . . . 5 KV by means of a transfer charging station 8, whereby the paper sheet 1 electrostatically adheres to the paper transport band 4. The paper transport band 4 transports the paper sheet 1 in direction A, whereby the paper sheet 1 wraps around the photoconductor drum 5 within an angle segment alpha, what is known as the nip angle. This in turn moves in direction B with the same speed as the paper sheet 1 or the transport band 4. Via the transfer charging station 8, the underside of the paper transport band 4 is charged with an electrical charge with a polarity opposite to the charged toner image on the photoconductor drum 5. The paper transport band 4, designed high-ohmic ($10^{10}$ Ω cm), stores the charge energy similar to a capacitor and represents a high counter-potential relative to the charged photoconductor drum 5. On the one hand, this effects the toner transfer from the photoconductor drum 5 onto the paper sheet and, on the other hand, this effects an adhesion force, decreasing over time t, of the paper sheet 1 to the paper transport band 4. Even after leaving the nip region, the paper sheet 1 still adheres to the paper transport band 4. At the driving roller 4*a* which the paper transport band 4 wraps around, the paper sheet 1 is loosened from the paper transport band 4 (due to the relatively small radius (11 mm) of the roller 4*a* and the effect of the stripping plate 4*c* and supplied to the fixing device 10, in which the toner image on the paper sheet 1 is fixed via heat and pressure exposure.

The paper transport band 4 is always held under tension by the tension roller 4*b* and is pressed under tension onto the photoconductor drum 5 in the nip region.

An electrostatically held toner image is generated on the photoconductor drum 5 as follows: the photoconductor drum 5 is initially charged to a high voltage with a charging station 6. Information is then applied point-by-point in an exposure station 7, for example via an LED comb or a laser, and discharge zones are achieved point-by-point on the photoconductor drum 5. Toner that is reserved in a developer station 29 and is prepared for attachment to the photoconductor drum 5 then attaches to these charge zones.

In the course of the transfer printing event, it is practically impossible to prevent that residual toner remains adhered to the photoconductor drum 5. The amount of the residual toner on the photoconductor drum is dependent on what is called the transfer printing degree of efficiency $\Pi_{Transfer}$, with $\Pi_{Transfer}<1$. The total residual toner on the photoconductor drum 5 thus results on the following basis:

Residual toner on photoconductor=$1-\Pi_{Transfer}$ (image information+toner marking+background).

Only in the cases in which image information exists outside of the recording medium format or in which toner markings have been generated on the photoconductor drum in the gaps between successive recording media is toner transferred onto the paper transport band. The residual toner on the paper transport band results according to:

$\Pi_{Transfer}$ (image information and background outside of the recording medium format+toner marking).

Figure 3:
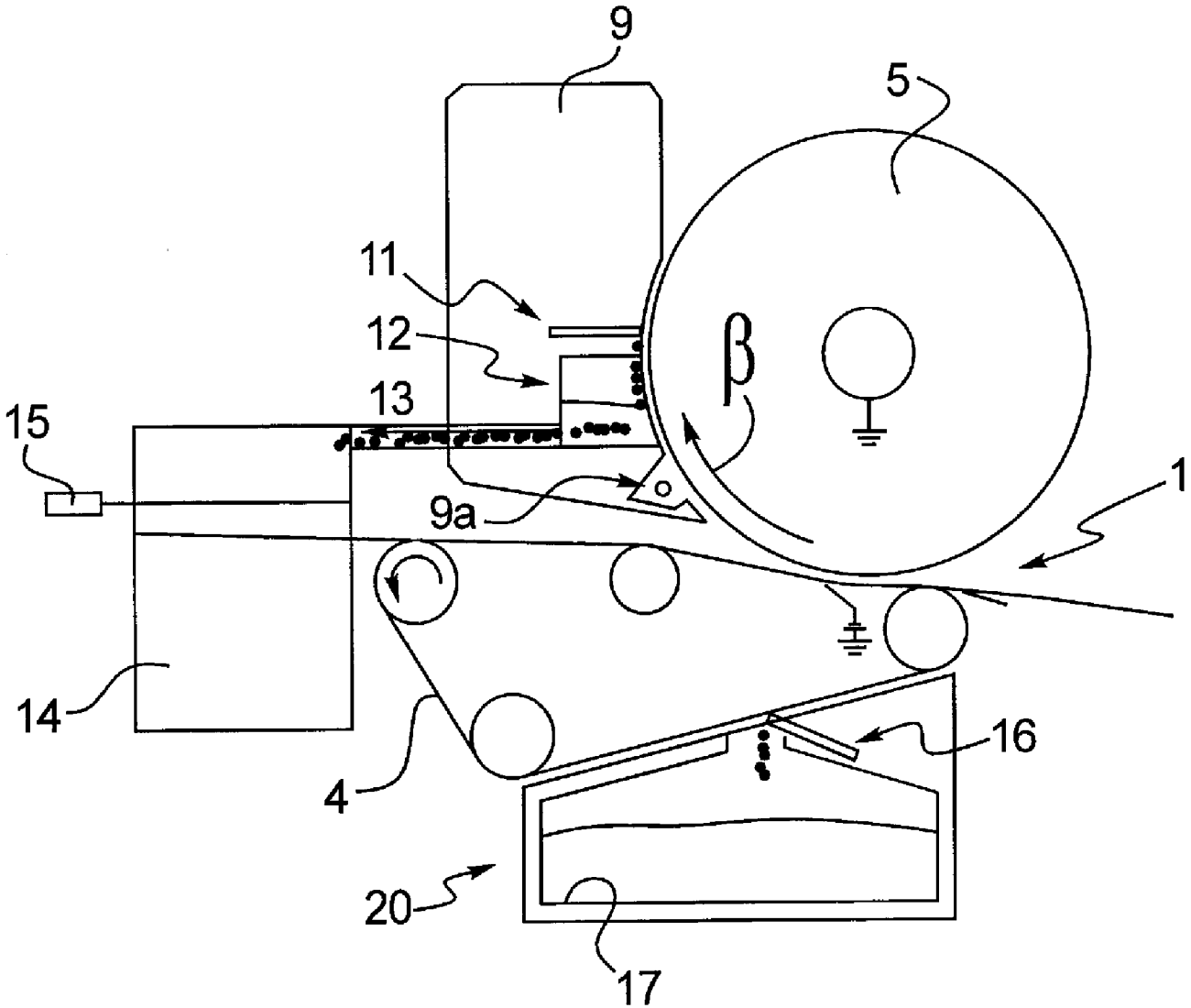
FIG. 3 shows a cleaning stations in a region of the transfer printing station.

In FIG. 3 it is shown how residual toner is removed form the photoconductor drum 5. For this, the photoconductor cleaning station 9 comprises a corona 9*a* to be operated with alternating current (AC), via which corona 9*a* the positively-charged residual toner that is still located on the photoconductor drum 5 after the transfer printing event is electrically neutralized. The electrostatic bonding forces between toner and photoconductor layer are therewith minimized. The charged toner is stripped from the photoconductor drum 5 with the aid of a rubber lip 11 (arranged dragging), caught in a capture reservoir 12 and subsequently transported with a conveying device 13 into a residual toner reservoir 14 outside of the transfer printing aggregate and easily accessible from the outside. The fill level of the residual toner reservoir 14 is monitored by means of a fill level sensor. At a certain fill level of the reservoir, the operator is prompted via a printer control panel transfer print change. If this is not implemented within a specific time, the printing process automatically stops in order to prevent an overfilling of the reservoir.

Possible residual toner that is transferred from the photoconductor drum 5 onto the paper transport band 4 is cleaned off with the aid of a scraping, flexible metal or plastic blade 16 arranged on the paper transport band 4 or a rigid ceramic blade. The blade 16 is thereby arranged directly above a second residual toner reservoir 17, such that the scraped-off toner particles fall directly into the residual toner reservoir 17. If the residual toner reservoir 17 is full, it must also be emptied or exchanged with an empty reservoir. If the fill level of the residual toner reservoir 17 is not monitored, the exchange of the reservoir should occur synchronously with that of the residual toner reservoir 14 of the photoconductor cleaning station 9. In order to prevent an overfilling of the residual toner reservoir 17, the volume of this reservoir must be selected so large that its maximum filling quantity does not exceed the maximum filling quantity of the monitored residual toner reservoir 14 in the photoconductor cleaning station 9. This requires a relatively large volume which requires a significant structural space in the region of the paper transport band and can barely be realized given a compact design of the printing system. It could also be provided to change the second residual toner reservoir 17 dependent on page counters. However, this can lead to the reservoir having to be changed relatively often, which on the one hand increases the consumption costs and on the other hand requires intervention of the operator, and thus leads to more frequent print interruption, which is not acceptable in a print production environment.

Figure 4:
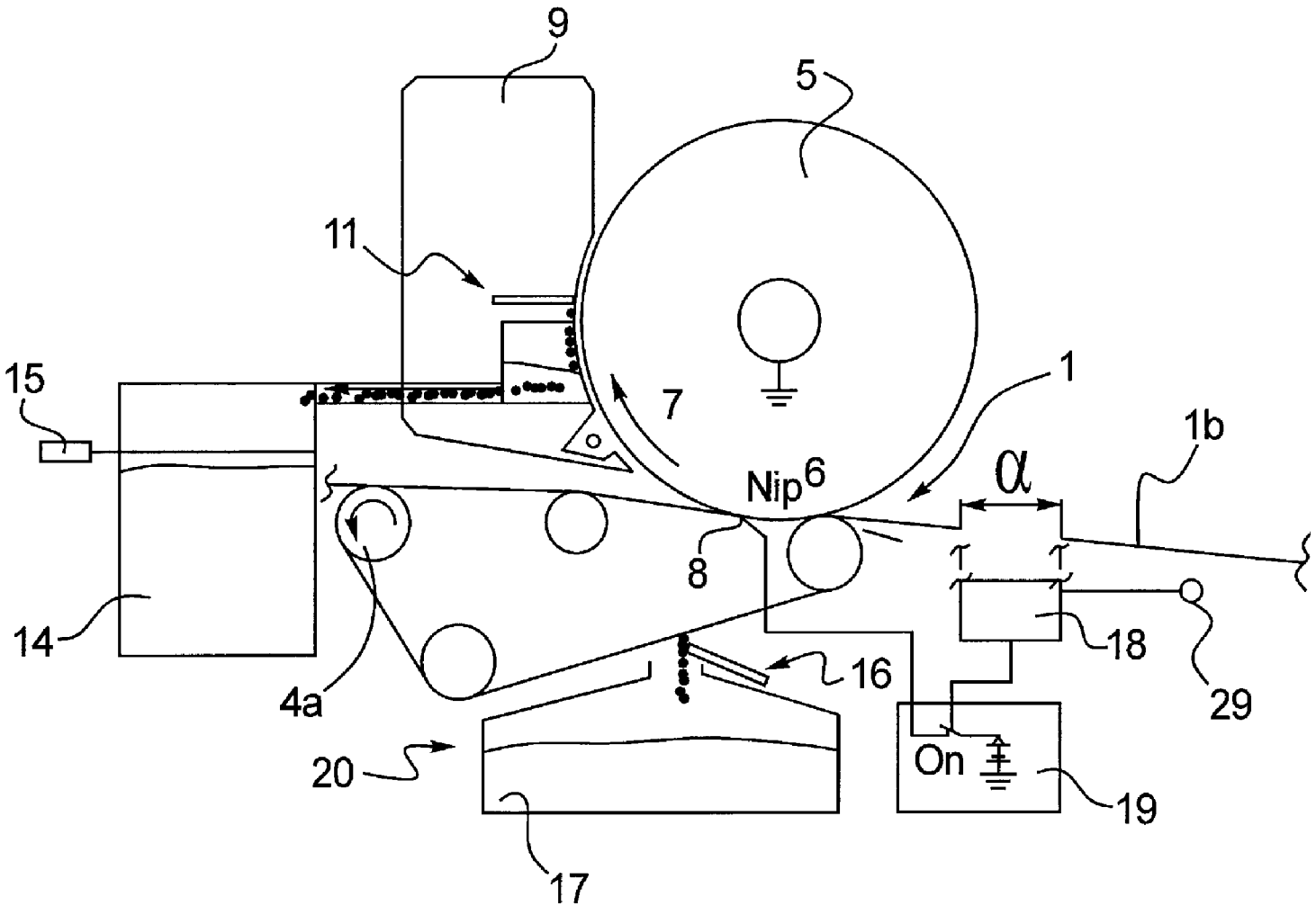
FIG. 4 shows a transfer printing station in an operational state with a recording medium on the light-sensitive medium.
Figure 5:
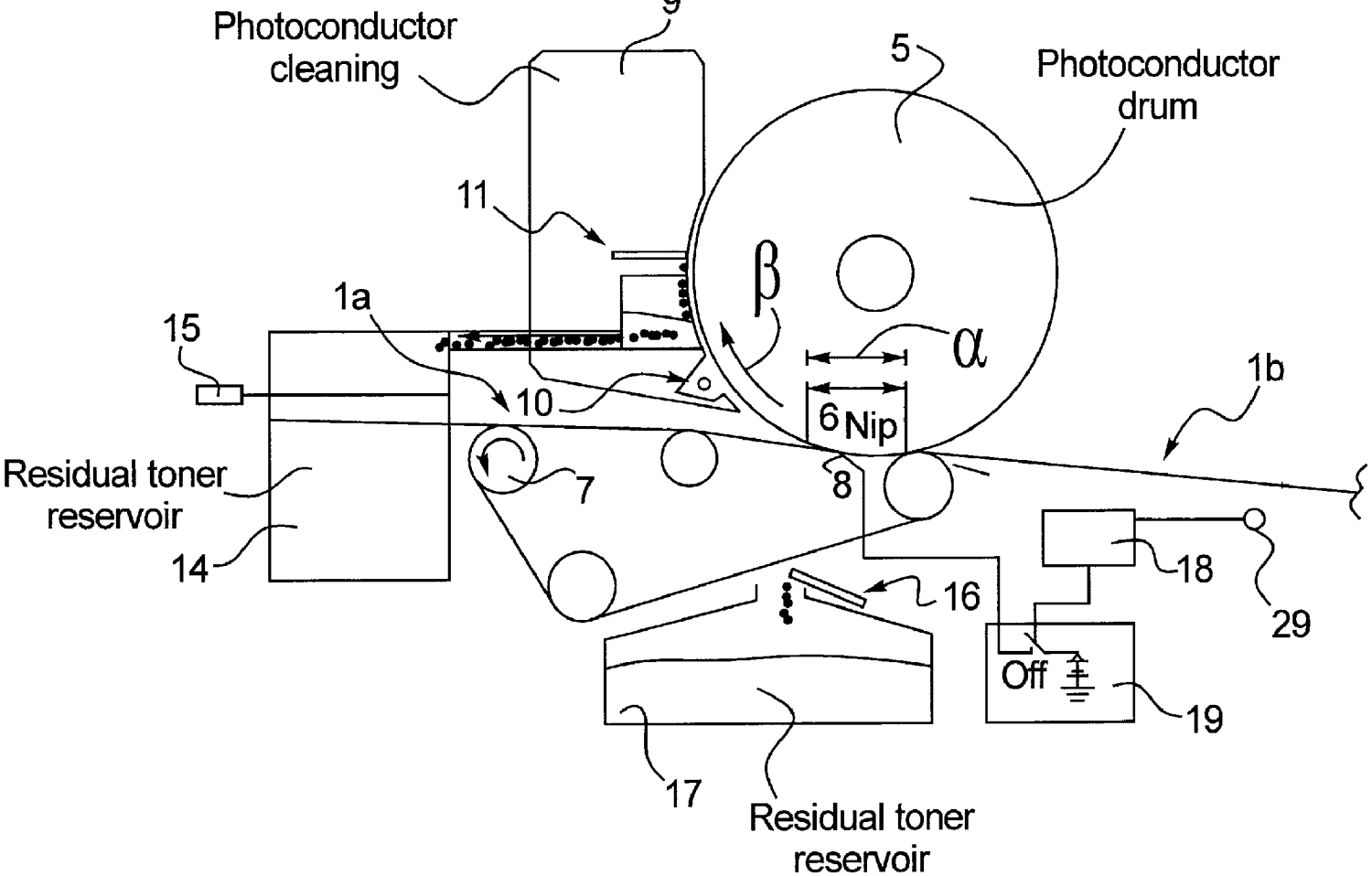
FIG. 5 illustrates the transfer printing station in an operational state without a recording medium on the light-sensitive medium.

In order to achieve an economical change cycle of the residual toner reservoir of the band cleaning station 17 given low fill volumes and thus less space requirement, the residual toner amount on the paper transport band is reduced in that the current for the transfer charge is deactivated in the charging station 8 in the intervening spaces of the individual pages to be printed (gap). FIGS. 4 and 5 show how it can be accomplished. For this, the control device 18 comprises an interface 29 via which it determines (from an imaging unit, for example from the exposure unit 7 or an upstream image processing unit) from which the page sequence is derived and which carries current supply 19 with which the transfer charging station is supplied. The current supply is thus deactivated over the length a within the interval of successive pages 1*a*, 1*b* (FIG. 5); during the printing it is activated (FIG. 4).

The distribution of the accumulated residual toner quantity is thus dependent on the status of the transfer current: within the format length (in the running direction) of the paper sheets, with activated transfer current the transfer printing degree of efficiency $\Pi_{Transfer}$ determines the ratio of the residual toner quantity on the photoconductor to the band. In contrast to this, between successive paper sheets, meaning when the gap passes the photoconductor drum 5, given deactivated transfer current the toner transfer only occurs due to the a real pressing between the paper transport band 4 and the photoconductor drum 5, meaning only dependent on a mechanical transfer printing degree of efficiency $\Pi_{mech}$, which with $\Pi_{mech}<0.5$ is significantly less than $\Pi_{Transfer}$.

Both states are added up as follows:

Residual toner on photoconductor=$1-\Pi_{Transfer}$ (image information and background within the maximum image development of the format line,)+$1-\Pi_{mech}$ (image information and background in the gap+toner marking).

Residual toner on paper transport band=$\Pi_{Transfer}$ (image information and background outside of the format width)+$\Pi_{mech}$ (image information and background in the gap+toner marking).

By means of the transfer current deactivation in the basic acquisition position, the accumulated residual toner quantity on the paper transport band 4 can thus be significantly reduced. In the specified printing systems, the maximum volumes of the residual toner reservoir of the band cleaning 17 are compensated to that of the photoconductor cleaning in the ratio of 1:1, since the maximum residual toner volume on the band does not exceed the volume of the residual toner on the photoconductor. Thus the information of how the fill level sensor 15 of the residual toner reservoir of the photoconductor cleaning 14 supplies can also be used for the exchange of the residual toner reservoir of the band cleaning 17. The operator then obtains the prompt to exchange and acknowledge both reservoirs at the same time.

Exemplary embodiments of the invention have been described. It is thus clear that the average man skilled in the art can specify modifications at any time in the framework of his specialist ability. For example, instead of a photoconductor drum a band-shaped light-sensitive medium that is coated with an organic photoconductor or an inorganic photoconductor can be specified.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

The invention claimed is:

1. A method for operation of a transfer printing station of an electrographic printing device, comprising the steps of:

providing a transfer printing station comprising a light-sensitive medium and adhering onto the medium successive toner images by electrostatic forces that are affected via a toner image electrical potential;

providing a transport band and holding respective successive sheet-form recording media by electrostatic forces on the transport band, and transfer printing the toner images from the light-sensitive medium onto the successive sheet-form recording media by use of electrostatic forces that are affected by an electrical transfer printing potential opposite said toner image electrical potential, and at least partially deactivating the electrical transfer printing potential while the light-sensitive medium passes an intervening space lying between two successive recording media sheets;

generating a toner marking on the light-sensitive medium;

with a cleaning station, cleaning off residual toner provided on the light-sensitive medium that is not transfer-printed, and a residual toner reservoir of the cleaning station accepting toner particles cleaned off the light-sensitive medium;

with a cleaning device provided at the transfer band, continuously mechanically loosening residual toner from the transport band, the residual toner falling into a residual toner reservoir associated with the transport band; and arranging a toner quantity sensor for at least one of the two residual toner reservoirs and emitting to an operator a request to exchange both residual toner reservoirs when the toner quantity sensor emits a full signal.

2. A method according to claim 1 wherein a control device is used which, from an image sequence of the electrographic recording process, derives at which times no recording medium lies against the light-sensitive medium and then effects the deactivating of the transfer printing potential.

3. A method according to claim 1 wherein the transport band has an electrical volume resistance greater than $10^{10}$ Ω cm, whereby the transfer printing potential also effects the electrostatic forces to hold the recording medium.

4. A method according to claim 1 wherein the cleaning station comprises at least one of a discharge device charged with alternating current and a mechanically-contacting cleaning element that permanently lies on the light-sensitive medium.

5. A method according to claim 4 wherein the mechanically contacting cleaning element comprises a rubber lip.

6. A method according to claim 1 wherein the toner quantity sensor is provided in the cleaning station and emits a "full" signal when a predetermined quantity of toner particles is reached in the residual toner reservoir of the cleaning station.

7. A method according to claim 6 wherein a conveying device is provided via which cleaned-off toner particles are transported into the residual toner reservoir of the cleaning station.

8. A method according to claim 1 wherein the cleaning device provided on the transport band comprises at least one of a flexible blade and a rigid ceramic blade.

9. A method according to claim 1 wherein after emission of the "full" signal of the toner quantity sensor, both the residual toner reservoir of the cleaning station of the light-sensitive medium and the residual toner reservoir of the transport band are at least one of emptied and exchanged for an empty reservoir.

10. A method according to claim 1 wherein a rotating photoconductor drum whose circumferential velocity during transfer printing is substantially the same as a transport speed of the transport band is used as the light-sensitive medium.

11. A transfer printing station for an electrographic printing device, comprising:

a light-sensitive medium on which successive toner images adhere by electrostatic forces affected via a toner image electrical potential;

a transport band on which successive sheet-form recording media are held for transfer printing of the toner images from the light-sensitive medium onto the sheet-form recording media, the recording media being held by electrostatic forces such that the transfer printing occurs by electrostatic forces affected by an electrical transfer printing potential opposite the potential of the toner image;

a control device via which the electrical transfer printing potential is at least partially deactivated during an intervening space lying between two successive recording media passing the light-sensitive medium;

a cleaning station cleaning off residual toner provided on the light-sensitive medium that is not transfer-printed, and a residual toner reservoir of the cleaning station accepting toner particles cleaned off the light-sensitive medium;

a cleaning device which continuously mechanically loosens residual toner from the transport band and which is provided at the transport band, the loosened residual toner falling into a residual toner reservoir associated with the transport band; and a toner quantity sensor arranged for at least one of the two residual toner reservoirs, and a request to exchange both residual toner reservoirs being emitted to the operator when the toner quantity sensor emits a full signal.

12. A transfer printing station according to claim 11 wherein from an image sequence of the electrographic recording process, the control device derives at which times no recording medium lies against the light-sensitive medium and then effects the deactivation of the transfer printing potential.

13. A transfer printing station according to claim 11 wherein the transport band has an electrical volume resistance greater than $10^{10}$ Ω cm, whereby the transfer printing potential also effects the electrostatic forces to hold the recording medium.

14. A transfer printing station according to claim 11 wherein the cleaning station comprises at least one of a discharge device charged with at alternating current and a mechanically-contacting cleaning element that permanently lies on the light-sensitive medium.

15. A transfer printing station according to claim 14 wherein the mechanically-contacting cleaning element comprises a rubber lip.

16. A transfer printing station according to claim 11 wherein the toner quantity sensor is provided in the cleaning station and emits a full signal when a predetermined quantity of toner particles is reached in the residual toner reservoir of the cleaning station.

17. A transfer printing station according to claim 16 wherein a conveying device is provided via which cleaned-off toner particles are transported into the residual toner reservoir of the cleaning station.

18. A transfer printing station according to claim 11 wherein the cleaning device provided on the transport band comprises at least one of a flexible blade and a rigid ceramic blade.

19. A transfer printing station according to claim 11 wherein both residual toner reservoirs are designed such that after emission of the full signal of the toner quantity sensor, both the residual toner reservoir of the cleaning station of the light-sensitive medium and the residual toner reservoir of the transport band are one of emptied and exchanged for an empty reservoir.

20. A transfer printing station according to claim 11 wherein a rotating photoconductor drum, whose circumferential velocity during transfer printing is the same as a transport speed of the transport band, is used as a light-sensitive medium.

21. A transfer printing station for an electrographic printing device, comprising:

a light-sensitive medium on which toner images are provided by electrostatic forces affected via a toner image electrical potential;

a transport band on which successive sheet-form recording media are held for transfer printing of the toner images from the light-sensitive medium onto the sheet-form recording media, the recording media being held by electrostatic forces such that the transfer printing occurs by electrostatic forces affected by an electrical transfer printing potential opposite the potential of the toner image;

a control device via which the electrical transfer printing potential is at least reduced during an intervening space lying between two successive recording media passing the light-sensitive medium;

a cleaning station cleaning off residual toner provided on the light-sensitive medium that is not transfer-printed, and a residual toner reservoir of the cleaning station accepting toner particles cleaned off the light-sensitive medium;

a cleaning device which continuously mechanically loosens residual toner from the transport band and which is provided at the transport band, the loosened residual toner falling into a residual toner reservoir associated with the transport band; and a toner quantity sensor for at least one of the two residual toner reservoirs, and providing an operator an indication to exchange both residual toner reservoirs.

* * * * *